US005669228A

United States Patent [19]

Iga et al.

[11] Patent Number: 5,669,228

[45] Date of Patent: Sep. 23, 1997

[54] SYSTEM FOR UTILIZING EXHAUST HEAT OF STATIONARY INDUCTION APPARATUS

[75] Inventors: Takashi Iga, Hitachi; Kaoru Endou, Ibaraki-ken; Takashi Shirone, Hitachi; Yoshito Uwano, Hitachi, all of Japan

[73] Assignee: Hitachi, Ltd., Tokyo, Japan

[21] Appl. No.: 636,262

[22] Filed: Apr. 24, 1996

[30] Foreign Application Priority Data

Apr. 26, 1995 [JP] Japan ..... 7-101902

[51] Int. Cl.[6] ..... F25B 27/00

[52] U.S. Cl. ..... 62/238.7; 237/2 B

[58] Field of Search ..... 237/2 B; 62/238.6, 62/238.7, 435; 165/80.4

[56] References Cited

U.S. PATENT DOCUMENTS

| | | | |
|---|---|---|---|
| 4,735,061 | 4/1988 | Hsieh | 237/2 B |
| 5,058,391 | 10/1991 | Periot | 62/238.6 |
| 5,243,825 | 9/1993 | Lin | 62/238.7 |
| 5,471,850 | 12/1995 | Cowans | 165/80.4 |
| 5,509,274 | 4/1996 | Lackstrom | 237/2 B |

OTHER PUBLICATIONS

"Electricity Joint Research", vol. 48, No. 2, Electricity Joint Research Association, Aug. 1992 (with English translation).

*Primary Examiner*—William E. Tapolcai

*Attorney, Agent, or Firm*—Fay, Sharpe, Beall, Fagan, Minnich & McKee

[57] ABSTRACT

An object of this invention is to provide a system for utilizing exhaust heat of a stationary induction apparatus in which highly-useful hot water, for example, of about 70° C. can be provided without increasing an operating temperature of the stationary induction apparatus (e.g. a transformer) to such an extent as to adversely affect the lifetime of the stationary induction apparatus. The system of the present invention includes a heat pump 17 which uses, as a high-temperature heat source, a first stationary induction apparatus cooling system which includes a first water-cooled stationary induction apparatus 1, and a first cooling water circulation system 7, and exhaust heat utilization means 8. This heat pump also uses, as a low-temperature heat source, a second stationary induction apparatus cooling system which includes a second stationary induction apparatus 10, and a second cooling water circulation system 16. There is further provided a refrigerator 26 which uses the second stationary induction apparatus cooling system as a high-temperature heat source, and also uses warm water 22 in a cable-cooling cold/warm water tank 21 as a low-temperature heat source.

14 Claims, 4 Drawing Sheets

SYSTEM FOR UTILIZING EXHAUST HEAT OF STATIONARY INDUCTION APPARATUS

BACKGROUND OF THE INVENTION

This invention relates to a system for utilizing exhaust heat of a stationary induction apparatus, and more particularly to a system for utilizing exhaust heat of a stationary induction apparatus, in which highly-useful hot water is obtained through exhaust heat of the stationary induction apparatus installed in an underground substation.

In a transmission-transformation apparatus in a substation, a large amount of heat loss develops from a stationary induction apparatus (e.g. a transformer) and power transmission cables installed underground. In the case of an underground substation, there is usually employed a water cooling system in which the heat, lost from the water-cooled stationary induction apparatus installed in the underground of a building or the like, is finally dissipated to the exterior from a cooling tower provided outdoors. In such a water cooling system, the heat, lost from a winding and core of the stationary induction apparatus, is transmitted to oil (which serves as a cooling and insulating medium) in a tank of the stationary induction apparatus, and is further transmitted to the cooling water through an oil-water heat exchanger provided outside of the tank. This cooling water is fed to the cooling tower provided outdoors, so that the heat is dissipated to the exterior.

One such water cooling system is of the independent type in which one cooling tower and one cooling water circulation means are provided for each transformer, and another such water cooling system is of the common type in which a plurality of transformers and a plurality of cooling towers are connected in parallel relation in one cooling water circulation system.

For effectively using the energy, recently- built underground substations are, in some cases, provided with an exhaust heat utilization system in which exhaust heat of a transformer, so far discarded outdoors, is utilized for heating the interior of a building or for supplying hot water. In this system, exhaust heat utilization means, such as a water-water heat exchanger, is provided between an oil-water heat exchanger of a stationary induction apparatus and an outdoor cooling tower. In some cases, ultrahigh-voltage substations are provided with a water tank for supplying cooling water to a water-cooled pipe installed in a cable tunnel for indirectly cooling transmission cables, and a refrigerator for cooling this cooling water. In this system, exhaust heat of the refrigerator cooling the cables is discarded to the exterior through an outdoor cooling tower, together with exhaust heat of the transformer and so on.

Such exhaust heat utilization system and cable cooling system are disclosed, for example, in "Electricity Joint Research, Vol. 48, No. 2" (Electricity Joint Research Association, August, 1992)

When exhaust heat of the stationary induction apparatus such as a transformer is utilized, generally, the higher the temperature of the warm water obtained from the oil-water heat exchanger is, the wider the extent of its application is, and hence the higher the value of use is. However, various troubles occur when the operation is effected while the temperature of the cooling water is kept high by the oil-containing transformer. For example, an insulator used in the transformer has such a nature that the degree of deterioration thereof is doubled for each 6° C. temperature rise, and the increased operating temperature leads to a shortened lifetime of the transformer.

Therefore, the temperature of the warm or hot water obtained from the oil-water heat exchanger of the oil-containing transformer is generally not more than 40° C. The use of the warm water of not more than 40° C. is limited to the supply of hot water and the heating of the interior of a building. On the other hand, when the temperature of the hot water obtained from the oil-water heat exchanger of the transformer is about 70° C., this hot water can be used as a heat source for driving an absorption refrigerator and hence as a heat source for an air-conditioning system for heating and cooling the interior of a building or an area air-conditioning (district heating and cooling) system, and also can be used as a heat source for driving a refrigerator for an underground cable. Thus, the value of use of the hot water of about 70° C. is high, and therefore it has been eagerly desired to achieve the type of water cooling system capable of providing hot water having high temperature.

The operating temperature of a transformer, using a perfluorocarbon (PFC) liquid or $SF_6$ gas as a refrigerant, can be higher than that of the oil-containing transformer. However, in this case, the higher the operating temperature is, the shorter the lifetime of the transformer is, and it has been virtually impossible to directly provide highly-useful hot water of not less than 70°.

Namely, even though the exhaust heat of the transformer in the conventional substation is large as a heat amount, it has provided the low-temperature heat source having a low value of use since the operating temperature of the transformer could not be made high. Therefore, most of the exhaust heat has been discarded to the atmosphere, and effective use thereof has been limited. Therefore, the utilization of the exhaust heat of the substation has not fully been advantageous, and the exhaust heat utilization system has not been extensively used.

And besides, in the conventional system for utilizing the exhaust heat of the transformer, if the temperature of the cooling water is set to a high level so as to obtain hot water whose temperature is as high as possible, the temperature difference between the cooling water of the cable cooling system and the cooling water of the transformer cooling system becomes large, and this has invited a problem that the efficiency of the system, incorporating the cable cooling system, has been lowered.

SUMMARY OF THE INVENTION

The present invention has been made in view of the above problems, and an object of the invention is to provide a system for utilizing exhaust heat of a stationary induction apparatus in which highly-useful hot water, for example, of about 70° C. can be provided without increasing an operating temperature of the stationary induction apparatus (e.g. a transformer) to such an extent as to adversely affect the lifetime of the stationary induction apparatus.

To achieve the above object, the present invention provides a system for utilizing exhaust heat of a stationary induction apparatus comprising a first stationary induction apparatus cooling system which comprises a water-cooled stationary induction apparatus, and a cooling water circulation system which includes a water-cooling heat exchanger for the stationary induction apparatus, a pump for circulating cooling water, and piping connecting the heat exchanger and the pump together; a second stationary induction apparatus cooling system separate from the first stationary induction apparatus cooling system; and exhaust heat utilization means for utilizing exhaust heat of the cooling water; wherein the exhaust heat utilization means is connected to the first stationary induction apparatus cooling system; and there is provided a heat pump which uses the first stationary induction apparatus cooling system as a high-temperature heat source, and also uses the second stationary induction apparatus cooling system as a low-temperature heat source.

The heat pump draws the exhaust heat from the second stationary induction apparatus cooling system serving as the low-temperature heat source, and transfers the heat to the first stationary induction apparatus cooling system serving as the high-temperature heat source. The circulating water in the first stationary induction apparatus cooling system cools the first stationary induction apparatus to be increased in temperature, and then is further increased in temperature by the heat supplied from the second stationary induction apparatus cooling system by the heat pump.

DESCRIPTION OF THE PREFERRED EMBODIMENTS

Figure 1:
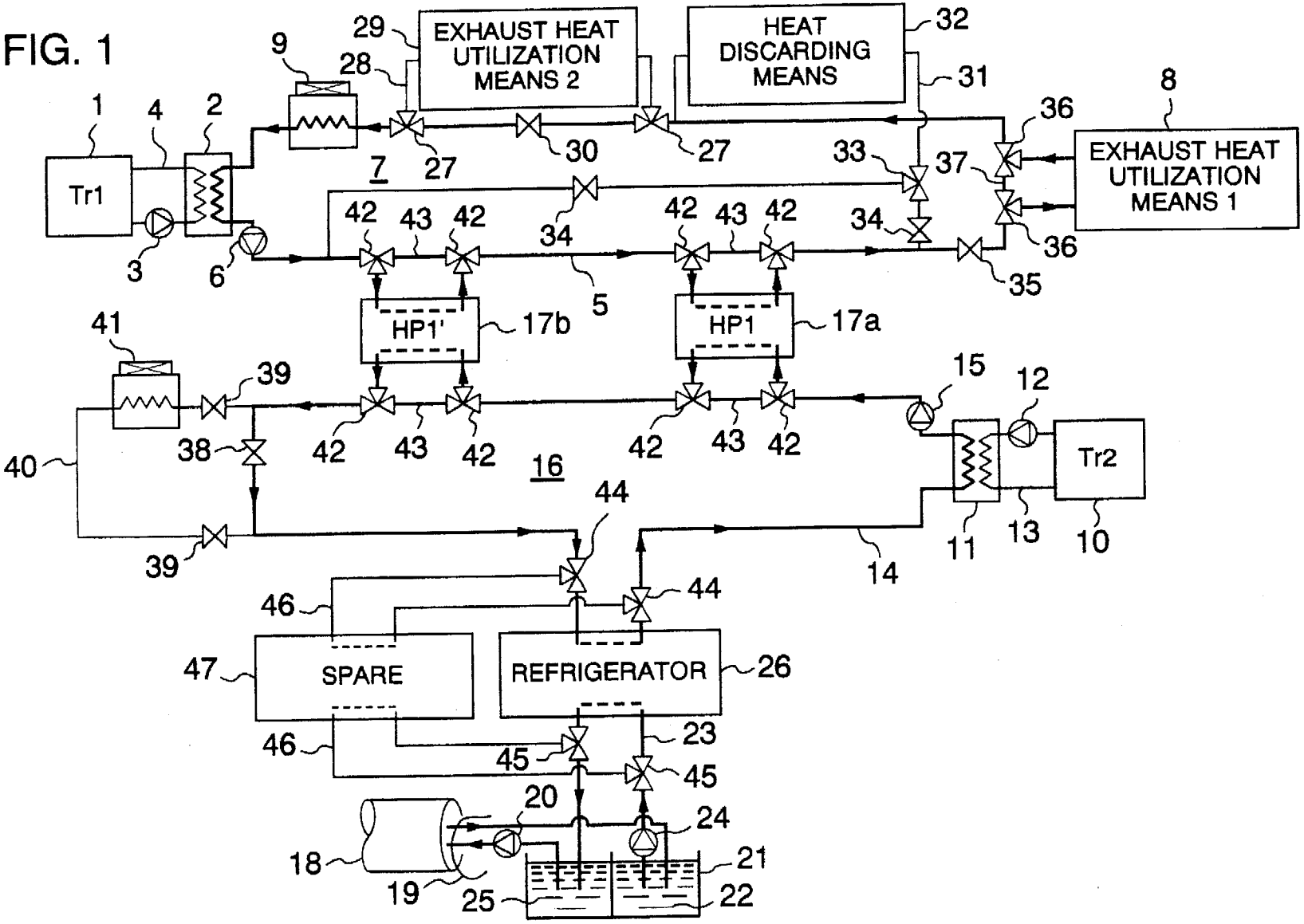
FIG. 1 is a system block diagram showing a system for utilizing exhaust heat of a stationary induction apparatus according to one embodiment of the present invention.

FIG. 1 is a system block diagram of a system for utilizing exhaust heat of a stationary induction apparatus according to one embodiment of the invention. In this Figure, reference numeral 1 denotes a first stationary induction apparatus, 2 a water-cooling heat exchanger, 3 a refrigerant circulation pump, 4 a refrigerant pipe, 5 a water pipe, and 6 a cooling water circulation pump. A first cooling water circulation system 7 comprises the water-cooling heat exchanger 2, the pump 6 and the water pipe 5, and this first cooling water circulation system 7 (indicated by a thick line in FIG. 1) and the first stationary induction apparatus 1 jointly constitute a first stationary induction apparatus cooling system. An exhaust heat utilization means 8 and a cooling tower 9 are provided in this first stationary induction apparatus cooling system. In this system, the water pipe 5 of the first cooling water circulation system 7 may be branched so that a plurality of groups each comprising the water-cooling heat exchanger 2 and the first stationary induction apparatus 1 can be arranged parallel to each other.

The system of the present invention for utilizing the exhaust heat of the stationary induction apparatus comprises a second stationary induction apparatus cooling system separate from the first stationary induction apparatus cooling system. Reference numeral denotes a second stationary induction apparatus, 11 a water-cooling heat exchanger, and 12 a refrigerant circulation pump, and the second stationary induction apparatus 10 cooperates with a second cooling water circulating system 16 (indicated by a thick line in FIG. 1), which includes the water-cooling heat exchanger 11, a refrigerant pipe 13, a water pipe 14 and a cooling water circulating pump 15, to constitute a second stationary induction apparatus cooling system. In this system, the water pipe 14 of the second cooling water circulation system 16 may be branched so that a plurality of groups each comprising the water-cooling heat exchanger 11 and the second stationary induction apparatus 10 can be arranged parallel to each other.

The system of the present invention for utilizing the exhaust heat of the stationary induction apparatus further comprises heat pumps 17 which use the first stationary induction apparatus cooling system as a high-temperature heat source, and also uses the second stationary induction apparatus cooling system as a low-temperature heat source. In this embodiment, there are provided two heat pumps 17*a* and 17*b*, and each of these is a mechanical heat pump, and part of the water pipe 5, disposed between the water-cooling heat exchanger 2 of the first cooling water circulation system 7 and the exhaust heat utilization means 8, is connected to a condenser (not shown) of each heat pump, and an evaporator (not shown) of each heat pump is connected to part of the water pipe 14 of the second cooling water circulation system. In this case, there may be provided only one heat pump 17.

In this embodiment, there is further provided a cooling system for transmission cables installed underground. Reference numeral 18 denotes a tunnel in which the transmission cables (not shown) are installed, 19 water pipes installed in the tunnel 18, 20 a pump, and 21 a cold/warm water tank. The cables (not shown) are indirectly cooled by circulating cooling water stored in the cold/warm water tank 21 through the water pipes 19. Warm water 22 in the cold/warm water tank 21 is drawn up by a pump 24, and is fed through a water pipe 23, and is cooled by an exterior cooling means, and then is returned as cold water 25 to the cold/warm water tank 21. In this embodiment, the exterior cooling means comprises a mechanical compression-type refrigerator 26 which uses the second stationary induction apparatus cooling system as a high-temperature heat source, and also uses the warm water 22 in the cold/warm water tank 21 as a low-temperature heat source. A condenser (not shown) of the refrigerator 26 is connected to part of the water pipe 14 disposed between the water-cooling heat exchanger 11 of the second cooling water circulation system 16 and the heat pump 17, and an evaporator of the refrigerator is connected to the cable-cooling water pipe 23.

The operation of the exhaust heat utilization system of this embodiment, applied to a system substation equipped with two main transformers having a capacity of 300 MVA, will now be described.

In FIG. 1, the first stationary induction apparatus 1 is constituted by the two main transformers with a capacity of 300 MVA using a perfluorocarbon liquid as a refrigerant. The rate of flow of the cooling water is set to about 3,500 liters/min so that water temperatures obtained at an outlet and an inlet of the water-cooling heat exchanger 2 of the first cooling water circulation system 7 respectively become 50° C. and 60° C., when the total heat loss in the rated load operation is 2,400 kW. The second stationary induction apparatus 10 is constituted by a shunt reactor with a capacity of 150 MVA and two station transformers with a capacity of 60 MVA, each of the reactor and the transformers using a perfluorocarbon liquid as a refrigerant. The rate of flow of the cooling water is set to about 2,000 liters/min so that water temperatures obtained at an outlet and an inlet of the water-cooling heat exchanger 11 of the second cooling water circulation system 16 respectively become 50° C. and 42° C., when the total heat loss in the rated load operation is 1,100 kW. Although the operating temperature of the stationary induction apparatus using the perfluorocarbon liquid as the refrigerant, can be higher than that of the conventional oil-containing stationary induction apparatus, the outlet temperature of the cooling water need to be set to about 60° C. in order to ensure the satisfactory lifetime. A heat loss of the cables is 1,500 kW, and the flow rate is so determined that the temperatures of the cold water 25 and warm water 22 in the cold/warm water tank 21 become 5° C. and 15° C., respectively.

The heat pump is a device which draws thermal energy from a low-temperature heat source through external work, and converts it into high-temperature thermal energy, and the sum of the low-temperature thermal energy and the input (electrical energy in the case of a mechanical compression-type heat pump) is outputted as the high-temperature thermal energy. The efficiency of the heat pump, commonly referred to as "coefficient of performance (COP)", is expressed in terms of the ratio of the output energy to the input energy, and the smaller the temperature difference between the low-temperature heat source and the high-temperature heat source is, the higher the efficiency is. In view of the fact that the low-temperature heat source is deprived of the heat, the heat pump performs the same function as that of a refrigerator. In the heat pumps 17 and the refrigerator 26 of this embodiment, the temperature difference between the low-temperature heat source and the high-temperature heat source can be set to a very small value, and therefore the coefficient of performance can be increased.

Specifically, if a heat pump having a performance coefficient of 8 is used as the cable-cooling refrigerator 26, the input energy required for cooling the cable heat loss of 1,500 kW is about 200 kW. Therefore, the output energy of the refrigerator 26 is about 1,700 kW, and this energy transfers to the second cooling water circulation system 16 serving as the high-temperature heat source of the refrigerator 26. With this heat, the temperature of the cooling water of the second stationary induction apparatus cooling system is increased about 10° C. to rise to 42° C., and this cooling water enters the water-cooling heat exchanger 11. This cooling water thus passes through the water-cooling heat exchanger 11 which cools the 1,100 kW heat loss of the second stationary induction apparatus 10, and therefore flows therefrom as hot water of 50° C.

The hot water of 50° C. flowing through the second cooling water circulation system 16 has the energy of 2,800 kW which is the sum of the heat loss of the cables, the input of the refrigerator 26 and the heat loss of the second stationary induction apparatus 10. The hot water of 50° C. in the second cooling water circulation system 16 passes through the heat pumps 17*a* and 17*b* to be deprived of the thermal energy, so that its temperature drops about 20° C., and then this water is returned to the refrigerator 26, and is circulated. If the coefficient of performance of each of the heat pumps 17*a* and 17*b* is 8, the required input energy of each heat pump is 200 kW. Therefore, the sum of the output energies of the two heat pumps 17 is about 3,200 kW, and this energy transfers to the first cooling water circulation system 7 serving as the high-temperature heat source of the heat pumps 17. With this heat, the cooling water, which is 60° C. at the outlet of the water-cooling heat exchanger 2 of the first cooling water circulation system 7, is increased about 15° C. to rise to about 75° C., and flows into the exhaust heat utilization means 8.

If the temperature difference between an outlet and an inlet of the exhaust heat utilization means 8 is set to 10° C., the exhaust heat of about 2,400 kW can be utilized in the form of highly-useful hot water of not less than 70° C. through the exhaust heat utilization means 8. Specifically, the exhaust heat utilization means 8 comprises an absorption cold/hot water device driven by this hot water, and this can be used for air-conditioning the interior of a building or for area air-conditioning. Also, since this hot water has a high value of use, the large-scale underground substation can be used as a base for supplying heat to an area air-conditioning system in a city which has now been under development.

In this embodiment, a second exhaust heat utilization means 29 can be provided by the use of bypass pipes 28 branching off from the water pipe 5 through three-way valves 27. By adjusting the flow rate of the second exhaust heat utilization means 29 by a valve 30, the balance between the supply of the remaining exhaust heat and the discarding thereof by the cooling tower 9 can be adjusted. For example, if the valve 30 is closed, and the temperature difference between an outlet and an inlet of the second exhaust heat utilization means 29 is set to 10° C., then the hot water can be supplied to the interior of a building or area air-conditioning facilities, utilizing the exhaust heat of about 2,400 kW whereas the remaining heat of 800 kW is discarded. The cooling water, finally returned to 50° C. at the cooling tower 9, is again returned to the water-cooling heat exchanger 2, and circulates through the first cooling water circulation system 7.

Thus, in this embodiment, the three heat sources the temperature difference between which is small, that is, the cable cooling system, the second stationary induction apparatus cooling system and the first stationary induction apparatus cooling system, are connected together, thereby using the heat pumps. having a very high performance coefficient. Accordingly, the performance coefficient of the system can be made very high. More specifically, with the sum of the inputs of the heat pumps 17 and the refrigerator 26 which was about 600 kW, the hot water of 60° C., circulating through the first cooling water circulation system 7 at the flow rate of 3,500 liters/min, could be raised in temperature to 75° C. If this temperature rise is achieved by only electrical energy, about 3,600 kW is required, and therefore the performance coefficient of the system is 6. Since the performance coefficient of the system is very high, there is achieved an advantage that the initial cost and running cost are lower as compared with a method using a boiler. And besides, the system is cleaner and safer as compared with the boiler, and therefore is best suited for an underground substation installed in a central portion of a city.

As described above, in this embodiment, there can be provided the system for utilizing the exhaust heat of the stationary induction apparatus in which the highly-useful hot water, for example, of about 70° C. can be provided while suppressing the increase of the operating temperature of the stationary induction apparatuses.

Next, reference is made to a method of operating the system of this embodiment when the thermal load in the exhaust heat utilization varies. Generally, the thermal load in the exhaust heat utilization varies depending on the season and time. For example, when the thermal load on the exhaust heat utilization means 8 decreases to such an extent that the cooling capacity of the cooling tower 9 becomes insufficient, the temperature of the cooling water entering the water-cooling heat exchanger 2 becomes high, so that there is a fear that the operating temperature of the first stationary induction apparatus 1 may become excessively high. In this embodiment, in the first cooling water circulation system 7, a bypass pipe 31 is connected parallel to the exhaust heat utilization means 8, and a heat discarding means 32 is provided on the bypass pipe 31. The flow rates of the exhaust heat utilization means 8 and the heat discarding means 32 are adjusted by three-way valves 33, 34 and 35. With this arrangement, in this embodiment, when the thermal load on the exhaust heat utilization means 8 varies, excess heat is discarded through the heat discarding means 32, thereby preventing the temperature of the first stationary induction apparatus from excessively rising, so that the reliability of the equipment can be improved.

Next, reference is made to a method of operating the system when part of the equipment is subjected to malfunction.

When the exhaust heat utilization means 8 is subjected to malfunction, the cooling water is circulated through a bypass pipe 37 by a three-way valve 36 of the exhaust heat utilization means 8. The operation of the heat pumps 17*a* and 17*b* is stopped, and the exhaust heat of the first stationary induction apparatus is discharged to the exterior through the cooling tower 9 or the second exhaust heat utilization means 29. A valve 38 of the second stationary induction apparatus cooling system is closed, and valves 39 are opened to circulate the cooling water through a bypass pipe 40, and the exhaust heat of the second stationary induction apparatus 10, as well as the exhaust heat of the cables, is discharged to the exterior through a cooling tower 41.

When either of the heat pumps 17*a* and 17*b* is subjected to malfunction, a three-way valve 42 of that heat pump out of order is switched to circulate the cooling water through a bypass pipe 43. In this case, the amount of the heat transferred from the second stationary induction apparatus cooling system to the first stationary induction apparatus cooling system is reduced to a half level, and therefore the flow rate of the bypass pipe 40 is adjusted by the valves 38 and 39 of the second cooling water circulation system 16, and a predetermined amount of the heat is discarded to the exterior through the cooling tower 41. When the refrigerator 26 is subjected to malfunction, three-way valves 44 of the second cooling water circulation system 16, as well as three-way valves 45 mounted on the water pipes 23 of the cold/warm water tank 21, are switched to circulate the cooling water through a bypass pipe 46, and then a spare refrigerator 47 is operated. Thus, in this embodiment, there is an advantage that even if part of the equipment is subjected to malfunction, the operation can be continued without stopping the whole of the system.

Figure 2:
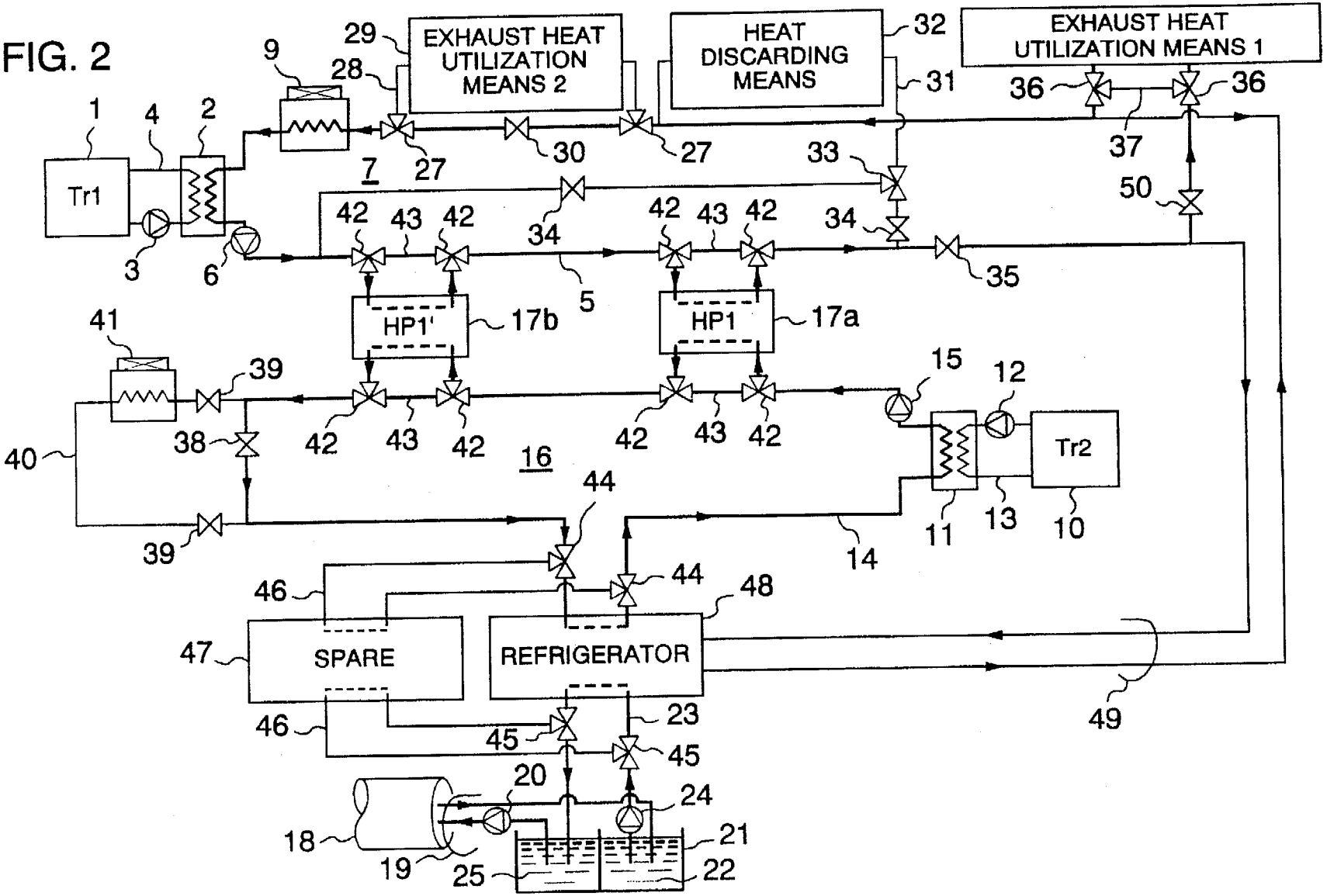
FIG. 2 is a system block diagram showing a system for utilizing exhaust heat of a stationary induction apparatus according to another embodiment of the present invention.

Another embodiment of the present invention will now be described with reference to FIG. 2.

In this Figure, the same constituent elements as those of FIG. 1 will be designated by the same reference numerals, respectively, and description thereof will be omitted. The embodiment of FIG. 2 is the same as the embodiment of FIG. 1 except that an absorption refrigerator is used for cooling cables and that part of exhaust heat of a first stationary induction apparatus cooling system is used as a drive source. In FIG. 2, reference numeral 48 denotes the absorption refrigerator, 49 bypass pipes connected parallel to an exhaust heat utilization means 8 of a first cooling water circulation system 7, and 50 a flow rate-adjusting valve. In this embodiment, part of hot water of not less than 70° C. used in the exhaust heat utilization means 8 is fed to the absorption refrigerator 48 through the bypass pipes 49 of the first cooling water circulation system 7, so that the exhaust heat can be used as the drive source. Generally, a performance coefficient of an absorption refrigerator or an absorption heat pump is small, and therefore when a heat pump having a performance coefficient of 2 is used as the absorption refrigerator 48, an energy of 1,500 kW must be inputted for transferring the cable exhaust heat of 1,500 kW. Therefore, although the amount of the heat that can be used in the exhaust heat utilization means 8 is smaller as compared with the first embodiment, this embodiment has an advantage that the input to the system is undertaken only by the input to the heat pump 17.

A further embodiment of the present invention will now be described with reference to FIG. 3.

In this Figure, the same constituent elements as those of FIG. 1 will be designated by the same reference numerals, respectively, and description thereof will be omitted. The embodiment of FIG. 3 is the same as the embodiment of FIG. 1 except that a first stationary induction apparatus cooling system is used as a high-temperature heat source of a cable-cooling refrigerator 26. In FIG. 3, the refrigerator 26 is connected to a first cooling water circulation system 7 at a region between a cooling water outlet side of a water-cooling heat exchanger 2 of the first cooling water circulation system 7 and a heat pump 17. Therefore, the cooling water, flowed from the water-cooling heat exchanger 2 of the first cooling water circulation system 7, is heated by exhaust heat of cables drawn up by the refrigerator 26 and an input energy of the refrigerator 26, and then is further heated by exhaust heat of a second stationary induction apparatus 10 drawn up by the heat pump 17 and an input energy of the heat pump 17. In this case, the temperature difference between warm water 22 in a cable-cooling cold/warm water tank 21 and the cooling water in the first cooling water circulation system 7 is slightly larger than that in the first embodiment, so that a performance coefficient of the refrigerator 26 is slightly lower. In this embodiment, however, the amount of the heat drawn up by the heat pump 17 is smaller, so that there is an advantage that the capacity of the heat pump 17 is smaller than that in the first embodiment. There is achieved another advantage that the first stationary induction apparatus 1 and the second stationary induction apparatus 10 can be operated at substantially the same temperature.

Figure 4:
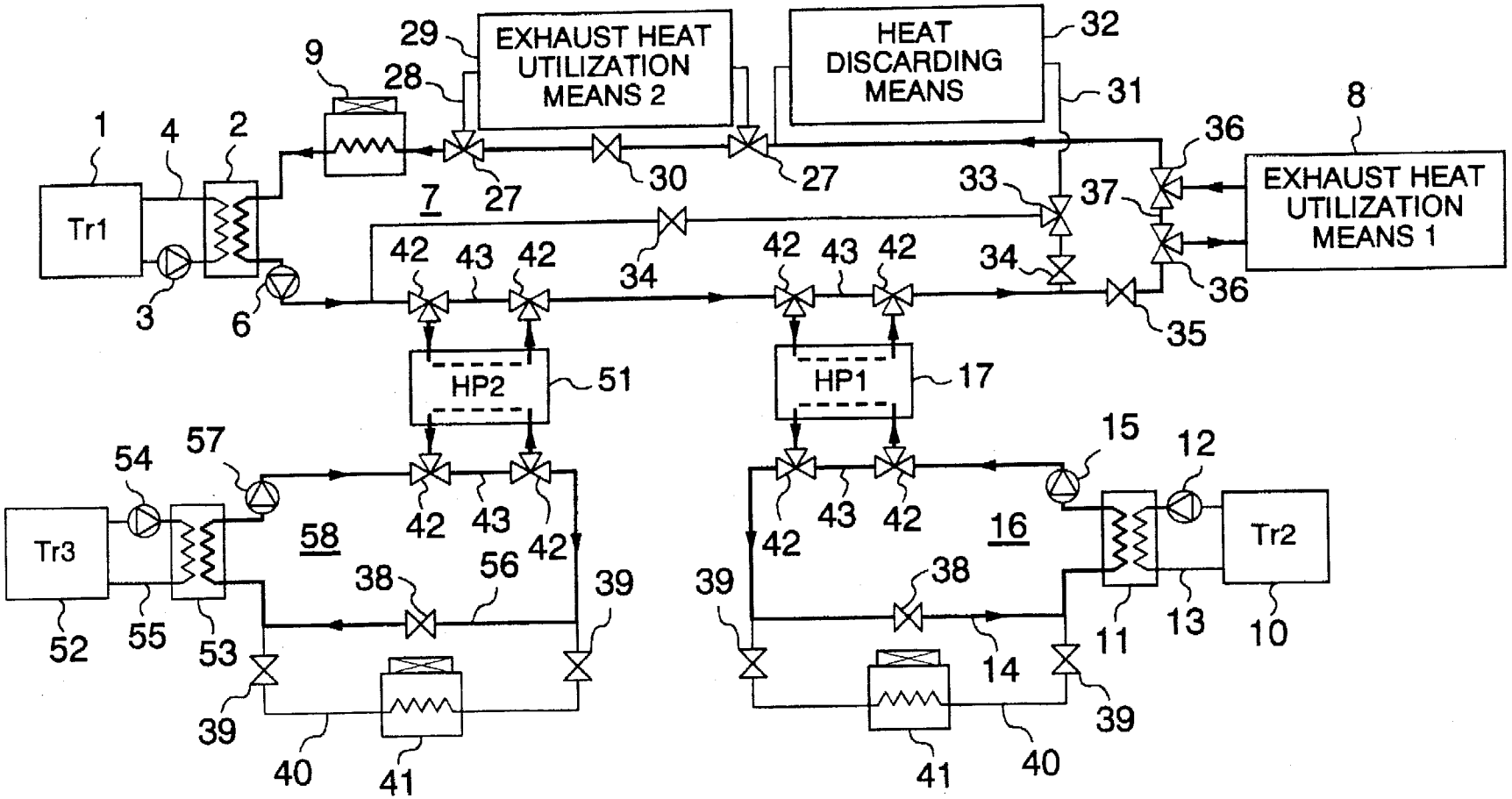
FIG. 4 is a system block diagram showing a system for utilizing exhaust heat of a stationary induction apparatus according to a still further embodiment of the present invention.

A still further embodiment of the present invention will now be described with reference to FIG. 4.

Figure 3:
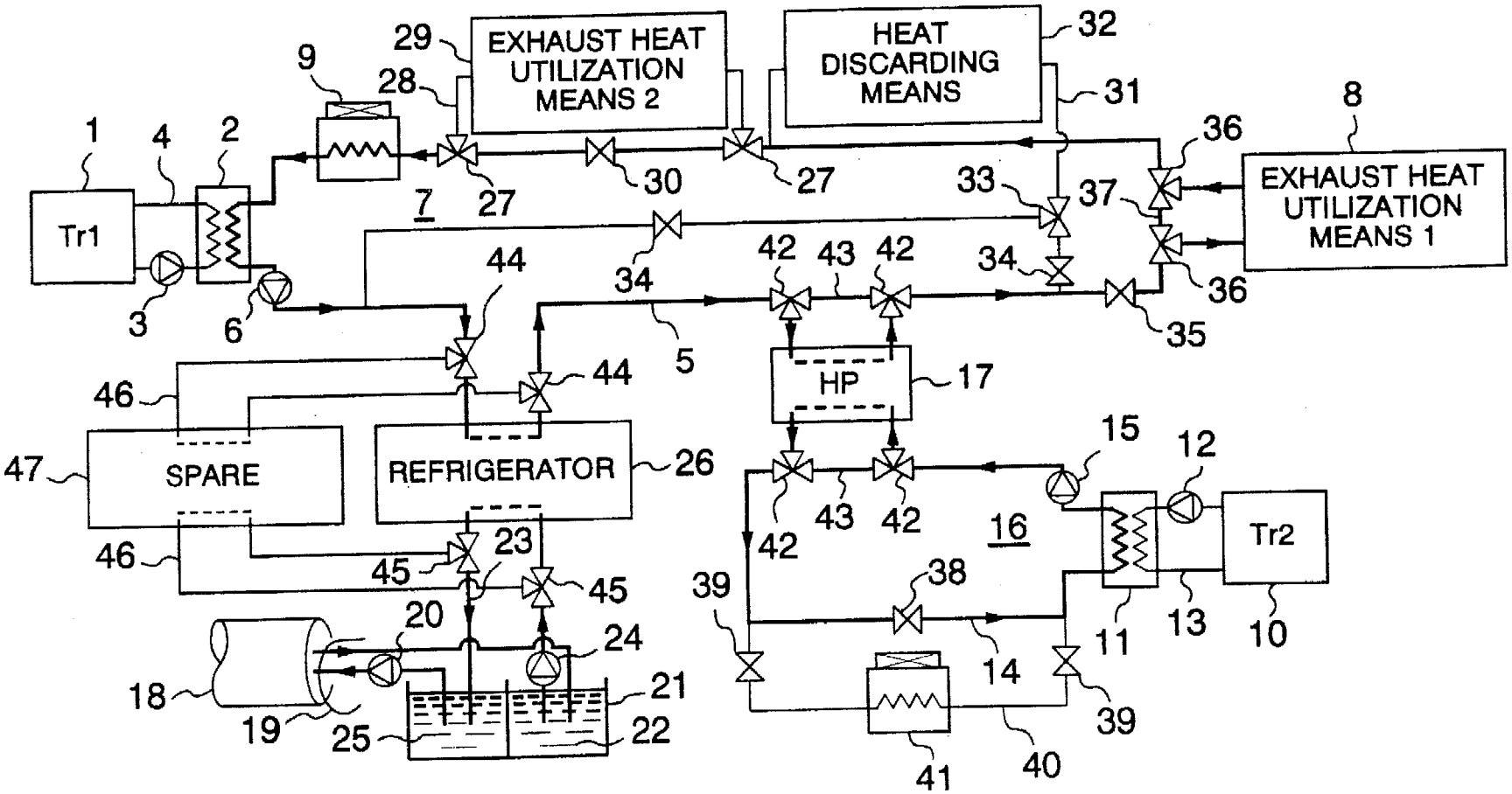
FIG. 3 is a system block diagram showing a system for utilizing exhaust heat of a stationary induction apparatus according to a further embodiment of the present invention.

In this Figure, the same constituent elements as those of FIGS. 1 and 3 will be designated by the same reference numerals, respectively, and description thereof will be omitted. In FIG. 4, instead of the cable cooling system of FIG. 3, there is provided a third stationary induction apparatus cooling system, and there is provided a second heat pump 51 instead of the refrigerator 26. The third stationary induction apparatus cooling system comprises a third cooling water circulating system 58 which includes a water-cooling heat exchanger 53, a water pipe 56 and a cooling water circulation pump 57, a third stationary induction apparatus 52, a refrigerant circulation pump 54, and a refrigerant pipe 55. In this system, the water pipe 56 of the third cooling water circulation system 58 may be branched so that a plurality of groups each comprising the water-cooling heat exchanger 53 and the third stationary induction apparatus 52 can be arranged parallel to each other. When this embodiment is applied to an underground substation having no cable cooling facilities, there is achieved an advantage that the exhaust heat of the equipment is efficiently used to provide hot water whose temperature is as high as possible.

In the present invention, there are advantageously provided the above systems for utilizing the exhaust heat of the stationary induction apparatus in which highly-useful hot water, for example, of about 70° C. can be provided while suppressing the increase of the operating temperature of the stationary induction apparatuses.

What is claimed is:

1. A system for utilizing exhaust heat of a stationary induction apparatus comprising a first stationary induction apparatus cooling system which comprises a water-cooled stationary induction apparatus, and a cooling water circulation system which includes a water-cooling heat exchanger for said stationary induction apparatus, a pump for circulating cooling water, and piping connecting said heat exchanger and said pump together; exhaust heat utilization means connected to said first stationary induction apparatus cooling system; a second stationary induction apparatus cooling system separate from said first stationary induction apparatus cooling system; and a heat pump 17A, 17B which uses said first stationary induction apparatus cooling system as a high-temperature heat source, and also uses said second stationary induction apparatus cooling system as a low-temperature heat source.

2. A system for utilizing exhaust heat of a stationary induction apparatus comprising a first stationary induction apparatus cooling system which comprises a water-cooled stationary induction apparatus, and a cooling water circulation system which includes a water-cooling heat exchanger for said stationary induction apparatus, a pump for circulating cooling water, and piping connecting said heat exchanger and said pump together; a second stationary induction apparatus cooling system separate from said first stationary induction apparatus cooling system; and exhaust heat utilization means for utilizing exhaust heat of the cooling water;

CHARACTERIZED in that said exhaust heat utilization means is connected to said cooling water circulation system of said first stationary induction apparatus cooling system; and there is provided a heat pump which uses said first stationary induction apparatus cooling system as a high-temperature heat source, and also uses said second stationary induction apparatus cooling system as a low-temperature heat source.

3. A system for utilizing exhaust heat of a stationary induction apparatus comprising a first stationary induction apparatus cooling system which comprises a water-cooled stationary induction apparatus, and a cooling water circulation system which includes a water-cooling heat exchanger for said stationary induction apparatus, a pump for circulating cooling water, and piping connecting said heat exchanger and said pump together; a second stationary induction apparatus cooling system separate from said first stationary induction apparatus cooling system; and exhaust heat utilization means for utilizing exhaust heat of the cooling water;

CHARACTERIZED in that said exhaust heat utilization means is connected to said cooling water circulation system of said first stationary induction apparatus cooling system; there is provided a first heat pump which uses said first stationary induction apparatus cooling system as a high-temperature heat source, and also uses said second stationary induction apparatus cooling system as a low-temperature heat source; and there is provided a second heat pump which uses said second stationary induction apparatus cooling system as a high-temperature heat source, and also uses a transmission cable-cooling water tank as a low-temperature heat source.

4. A system for utilizing exhaust heat of a stationary induction apparatus according to claim 3, in which said first heat pump is connected to said first stationary induction apparatus cooling system at a region between a cooling water outlet side of said water-cooling heat exchanger of said first stationary induction apparatus cooling system and said exhaust heat utilization means; and said second heat pump is connected to said second stationary induction apparatus cooling system at a region between a cooling water inlet side of a water-cooling heat exchanger of said second stationary induction apparatus cooling system and said first heat pump.

5. A system for utilizing exhaust heat of a stationary induction apparatus comprising a first stationary induction apparatus cooling system which comprises a water-cooled stationary induction apparatus, and a cooling water circulation system which includes a water-cooling heat exchanger for said stationary induction apparatus, a pump for circulating cooling water, and piping connecting said heat exchanger and said pump together; a second stationary induction apparatus cooling system separate from said first stationary induction apparatus cooling system; and exhaust heat utilization means for utilizing exhaust heat of the cooling water;

CHARACTERIZED in that said exhaust heat utilization means is connected to said cooling water circulation system of said first stationary induction apparatus cooling system; there is provided a first heat pump which uses said first stationary induction apparatus cooling system as a high-temperature heat source, and also uses said second stationary induction apparatus cooling system as a low-temperature heat source; and there is provided a second heat pump which uses said first stationary induction apparatus cooling system as a high-temperature heat source, and also uses a transmission cable-cooling water tank as a low-temperature heat source.

6. A system for utilizing exhaust heat of a stationary induction apparatus comprising a first stationary induction apparatus cooling system which comprises a water-cooled stationary induction apparatus, and a cooling water circulation system which includes a water-cooling heat exchanger for said stationary induction apparatus, a pump for circulating cooling water, and piping connecting said heat exchanger and said pump together; a second stationary induction apparatus cooling system separate from said first stationary induction apparatus cooling system; a third stationary induction apparatus cooling system separate from said first and second stationary induction apparatus cooling systems; and exhaust heat utilization means for utilizing exhaust heat of the cooling water;

CHARACTERIZED in that said exhaust heat utilization means is connected to said cooling water circulation system of said first stationary induction apparatus cooling system; there is provided a first heat pump which uses said first stationary induction apparatus cooling system as a high-temperature heat source, and also uses said second stationary induction apparatus cooling system as a low-temperature heat source; and there is provided a second heat pump which uses said first stationary induction apparatus cooling system as a high-temperature heat source, and also uses said third stationary induction apparatus cooling system as a low-temperature heat source.

7. A system for utilizing exhaust heat of a stationary induction apparatus according to claim 5, in which said first heat pump is connected to said first stationary induction apparatus cooling system at a region between a cooling water outlet side of said water-cooling heat exchanger of said first stationary induction apparatus cooling system and said exhaust heat utilization means; and said second heat pump is connected to said first stationary induction apparatus cooling system at a region between the cooling water outlet side of a water-cooling heat exchanger of said second stationary induction apparatus cooling system and said first heat pump.

8. A system for utilizing exhaust heat of a stationary induction apparatus according to claim 1, in which said first heat pump and/or said second heat pump comprise an absorption heat pump which uses the cooling water of the first stationary induction apparatus cooling system as a drive source.

9. A system for utilizing exhaust heat of a stationary induction apparatus according to claim 1, in which said exhaust heat utilization means comprises an absorption cold/warm water device.

10. A system for utilizing exhaust heat of a stationary induction apparatus according to claim 1, in which said exhaust heat utilization means comprises a heat storage tank of an area air-conditioning system.

11. A system for utilizing exhaust heat of a stationary induction apparatus according to claim 1, in which a cooling tower is provided between a cooling water inlet side of said water-cooling heat exchanger of said first stationary induction apparatus cooling system and said exhaust heat utilization means and/or between a cooling water inlet side of a water-cooling heat exchanger of said second stationary induction apparatus cooling system and said heat pump.

12. A system for utilizing exhaust heat of a stationary induction apparatus according to claim 1, in which a bypass pipe including heat discarding means is provided at a portion of said cooling water circulation system of said first stationary induction apparatus cooling system in parallel relation to said exhaust heat utilization means.

13. A system for utilizing exhaust heat of a stationary induction apparatus according to claim 1, in which a refrigerant for a winding and core of each of said first stationary induction apparatus and a second stationary induction apparatus is a perfluorocarbon liquid or sulfur hexafluoride gas.

14. A system for utilizing exhaust heat of a stationary induction apparatus according to claim 1, in which the temperature of the water at an outlet side of said water-cooling heat exchanger of said first stationary induction apparatus cooling system is not less than 55° C., and the temperature of the water at an inlet side of at least one of said exhaust heat utilization means connected to said first stationary induction apparatus cooling system is not less than 65° C.

* * * * *